US006496666B2

(12) United States Patent
Hayashi et al.

(10) Patent No.: US 6,496,666 B2
(45) Date of Patent: Dec. 17, 2002

(54) IMAGE FORMING APPARATUS AND METHOD HAVING AN IMPROVED HEATING MECHANISM IN FIXING DEVICE

(75) Inventors: Shohji Hayashi, Yokohama (JP); Tadao Uehara, Kakogawa (JP); Kenichi Hasegawa, Kawasaki (JP); Setsuo Soga, Mitaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/862,326

(22) Filed: May 23, 2001

(65) Prior Publication Data

US 2002/0009306 A1 Jan. 24, 2002

(30) Foreign Application Priority Data

May 23, 2000 (JP) ..... 2000-151627
Apr. 27, 2001 (JP) ..... 2001-131556

(51) Int. Cl.[7] ..... G03G 15/20
(52) U.S. Cl. ..... 399/69; 219/216; 399/329
(58) Field of Search ..... 399/69, 328, 319; 118/60; 219/216; 432/59, 60; 430/124

(56) References Cited

U.S. PATENT DOCUMENTS 3,948,215 A * 4/1976 Namiki ..... 118/60
4,813,868 A 3/1989 Soga
4,934,930 A 6/1990 Soga ..... 432/60
5,729,812 A 3/1998 Moser ..... 399/329
5,890,032 A * 3/1999 Aslam et al. ..... 399/329
6,131,009 A 10/2000 Hasegawa ..... 399/328

FOREIGN PATENT DOCUMENTS

| | | |
|---|---|---|
| EP | 0 962 837 | 12/1999 |
| JP | 52-69337 | 6/1977 |
| JP | 06318001 A | 11/1994 |
| JP | 10104979 A | 4/1998 |
| JP | 2000081805 A | 3/2000 |

* cited by examiner

*Primary Examiner*—Joan Pendegrass
(74) *Attorney, Agent, or Firm*—Oblon, Spivak, McClelland, Maier & Neustadt, P.C.

(57) ABSTRACT

A fixing device having an endless fixing belt configured to convey a sheet-like medium on which a toner image is to be fixed, heating and fixing rollers having the fixing belt wound thereon, and a pressing roller disposed opposite to the fixing roller having fixing belt wound thereon to form a nip portion between the fixing belt and pressing roller. The fixing device also including first to third heaters provided in the heating, pressure and fixing rollers respectively, and first to third voltage applying devices configured to apply voltages to the first to third heaters respectively. The nip portion is configured to perform the fixing only by pressure contact between said fixing and pressing rollers via said fixing belt.

22 Claims, 7 Drawing Sheets

FIG. 7

COMPARISON OF GLOSSINESS BETWEEN THE CASES WHEN HEATER 17 EXISTS OR NOT

| NUMBER OF FED SHEETS | HEATER 17 EXISTS (IMMEDIATELY AFTER POWER SOURCE IS TURNED ON) | HEATER 17 DOES NOT EXISTS (IMMEDIATELY AFTER POWER SOURCE IS TURNED ON) |
|---|---|---|
| 1 | 13.3% | 8.7% |
| 2 | 23.1% | 16.8% |
| 3 | 28.7% | 20.6% |
| 4 | 29.8% | 20.7% |
| 5 | 29.1% | 22.5% |
| AVE. | 24.8% | 17.9% |

IMAGE FORMING APPARATUS AND METHOD HAVING AN IMPROVED HEATING MECHANISM IN FIXING DEVICE

BACKGROUND OF THE INVENTION

1. Field of the Invention

The present invention relates to a fixing device, more particularly to a belt fixing device having a so-called endless belt, and an image forming apparatus such as a copying machine, a facsimile or a printer having the same.

2. Discussion of the Background

An image forming apparatus such as a copying machine, a facsimile, a printer or a printing machine generally includes a fixing device for fixing a toner image on a sheet-like medium, on which the toner image to be fixed has been formed.

With regard to the fixing device, the related art has presented a heat roller pair type fixing device, and a so-called belt fixing device. The former includes a rotary-driven heating roller which has a heat source provided therein, and a pressing roller pressed into contact with the heating roller and rotated therewith. This device is designed to pass a sheet through a nip portion formed by the two rollers, based on the rotations of the rollers, and then fix a toner image to a medium by applying heat and pressure. The belt fixing device includes an endless fixing belt for conveying a sheet-like medium on which a toner image is to be fixed, heating and fixing rollers having the fixing belt wound thereon, a pressing roller disposed opposite to the fixing roller via the fixing belt, and so on.

For the belt fixing device, to provide a quantity of heat necessary for fixing a toner image on the sheet-like medium during fixing, a device having heaters provided in the heating and pressing rollers has been available. However, although the heater is provided in the pressing roller, it is difficult to increase the temperature of the fixing roller by the heater of the pressing roller. This is because the fixing roller, which forms a nip portion with the pressing roller, is generally made of a material such as silicon rubber or the like having a large heat capacity. Consequently, as recognized by the present inventors, when the fixing belt is rotated during fixing, if a portion of the fixing belt heated by a heating roller is abutted on the low-temperature fixing roller, the heat is absorbed by the fixing roller to steeply lower the temperature of the fixing belt. The quantity of heat necessary for fixing then becomes insufficient causing a fixing failure. This problem is particularly conspicuous when the temperatures of the fixing roller and the fixing belt are lowered at the time of rising temperature after the power source of the image forming apparatus, is turned on or with the passage of time after the previous image formation.

To solve the above-described problem, the fixing belt may be subjected to preparatory rotation, i.e., pre-rotation, for a long time, before the start of fixing. This allows the fixing operation to be started after a sufficient increase in the temperature of the fixing roller. However, this pre-rotation takes too much time before the start of the fixing, which runs counter to a recent tendency to place importance on the shortening of image forming time.

In addition, to shorten the image forming time, efforts have been made to increase a speed for conveying a sheet-like medium. Such an increase in the conveying speed of the sheet-like medium is particularly important in the case of an image forming apparatus designed for color image formation, because it takes relatively longer time to form a color toner image. Thus, an increase in the conveying speed of the fixing belt has become important in the belt fixing device provided in the color image forming apparatus. However, the increase in the conveying speed of the fixing belt results in the shortened staying time of the sheet-like medium in the nip portion. Therefore, in the case of increasing the conveying speed of the sheet-like medium, it is more difficult to provide the quantity of heat necessary for fixing an image thereby causing a fixing failure. Moreover, in color image formation, desired high and stable glossiness of the image cannot be obtained.

SUMMARY OF THE INVENTION

An object of the present invention is to provide a belt fixing device capable of preventing a reduction in the temperature of a fixing belt caused by its abutment on a low-temperature fixing roller. Another object is to provide an image forming apparatus equipped with such a fixing device.

According to a preferred embodiment of the present invention, a fixing device includes: an endless fixing belt configured to convey a sheet-like medium on which a toner image is to be fixed; heating and fixing rollers configured to have said fixing belt wound thereon; a pressing roller configured to be disposed opposite to said fixing roller via said fixing belt; and wherein said fixing device further comprises first to third heaters configured to be provided respectively in said heating, pressing and fixing rollers; first to third voltage applying devices configured to apply voltages respectively to said first to third heaters; and a nip portion configured to perform the fixing only by pressure contact between said fixing and pressing rollers via said fixing belt.

Further, said third voltage applying device is identical to said first or second voltage applying device.

Further, the fixing device further includes: first temperature detecting device configured to be disposed opposite to said heating roller via said fixing belt to detect a temperature of said heating roller; and second temperature detecting device configured to be disposed opposite to said pressing roller to detect a temperature of said pressing roller, wherein on the basis of a temperature detected by said first or second temperature detecting device, said third heater and said first or second heater are simultaneously controlled by said identical voltage applying device.

According to another preferred embodiment of the present invention, a fixing device includes: an endless fixing belt configured to convey a sheet-like medium on which a toner image is to be fixed; heating and fixing rollers configured to have said fixing belt wound thereon; a pressing roller configured to be disposed opposite to said fixing roller via said fixing belt; and wherein said fixing device further comprises first to third heaters configured to be provided respectively in said heating, pressing and fixing rollers, and first to third voltage applying devices configured to apply voltages respectively to said first to third heaters; and said third voltage applying device is identical to said first or second voltage applying device.

Further, the fixing device further includes: first temperature detecting device configured to be disposed opposite to said heating roller via said fixing belt to detect a temperature of said heating roller; and second temperature detecting device configured to be disposed opposite to said pressing roller to detect a temperature of said pressing roller, wherein on the basis of a temperature detected by said first or second temperature detecting device, said third heater and said first or second heater are simultaneously controlled by said identical voltage applying device.

According to another preferred embodiment of the present invention, a fixing device includes: an endless fixing belt configured to convey a sheet-like medium, on which a toner image is to be fixed; heating and fixing rollers configured to have said fixing belt wound thereon; a pressing roller configured to be disposed opposite to said fixing roller via said fixing belt; and wherein said fixing device further comprises first to third heaters configured to be provided respectively in said heating, pressing and fixing rollers, and first to third voltage applying devices configured to apply voltages respectively to said first to third heaters; said third voltage applying device is identical to said first or second voltage applying device; temperature detecting device is provided in a roller having a higher thermal responsiveness; and on the basis of a temperature detected by said temperature detecting device, said third heater and said first or second heater are simultaneously controlled by said identical voltage applying device.

Further, said heaters having voltages applied thereto by said identical voltage applying device are connected to the voltage applying device in parallel.

Further, outputs W1, W2 and W3 of said first to third heaters are set to satisfy a relation of W1>W2>W3.

According to another preferred embodiment of the present invention, an image forming apparatus includes: an image forming device configured to form an toner image on a photosensitive member and to transfer the toner image on a sheet-like medium; and a fixing device configured to fix the toner image on the sheet-like medium, which is specified in claim 1, 4 or 6.

Further, the image forming apparatus is capable of forming color images.

According to another preferred embodiment of the present invention, a fixing method includes: conveying a sheet-like medium on which a toner image is to be fixed by an endless fixing belt; applying voltages respectively to first to third heaters by first to third voltage applying devices; heating said first to third heaters provided respectively in heating, pressing and fixing rollers; and performing the fixing only by pressure contact between said fixing and pressing rollers via said fixing belt by a nip portion.

According to another preferred embodiment of the present invention, a fixing method includes: conveying a sheet-like medium on which a toner image is to be fixed by an endless fixing belt; applying voltages respectively to first to third heaters by first to third voltage applying devices; heating said first to third heaters provided respectively in heating, pressing and fixing rollers; and wherein said third voltage applying device is identical to said first or second voltage applying device.

According to another preferred embodiment of the present invention, a fixing method includes: conveying a sheet-like medium on which a toner image is to be fixed by an endless fixing belt; applying voltages respectively to first to third heaters by first to third voltage applying devices; heating said first to third heaters provided respectively in heating, pressing and fixing rollers; and wherein said third voltage applying device is identical to said first or second voltage applying device; a temperature detecting device is provided in a roller having a higher thermal responsiveness; and on the basis of a temperature detected by said temperature detecting device, said third heater and said first or second heater are simultaneously controlled by said identical voltage applying device.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompanying drawings, wherein:

FIG. 7 is a correlation view showing a correlation between the number of fed sheet-like media and glossiness of an image formed on each of the sheet-like media at the time of temperature rising of the fixing device, and showing comparison of glossiness between a case where the fixing roller has a heater and the case where the fixing roller has no heaters.

DESCRIPTION OF THE PREFERRED EMBODIMENTS

Figure 1:
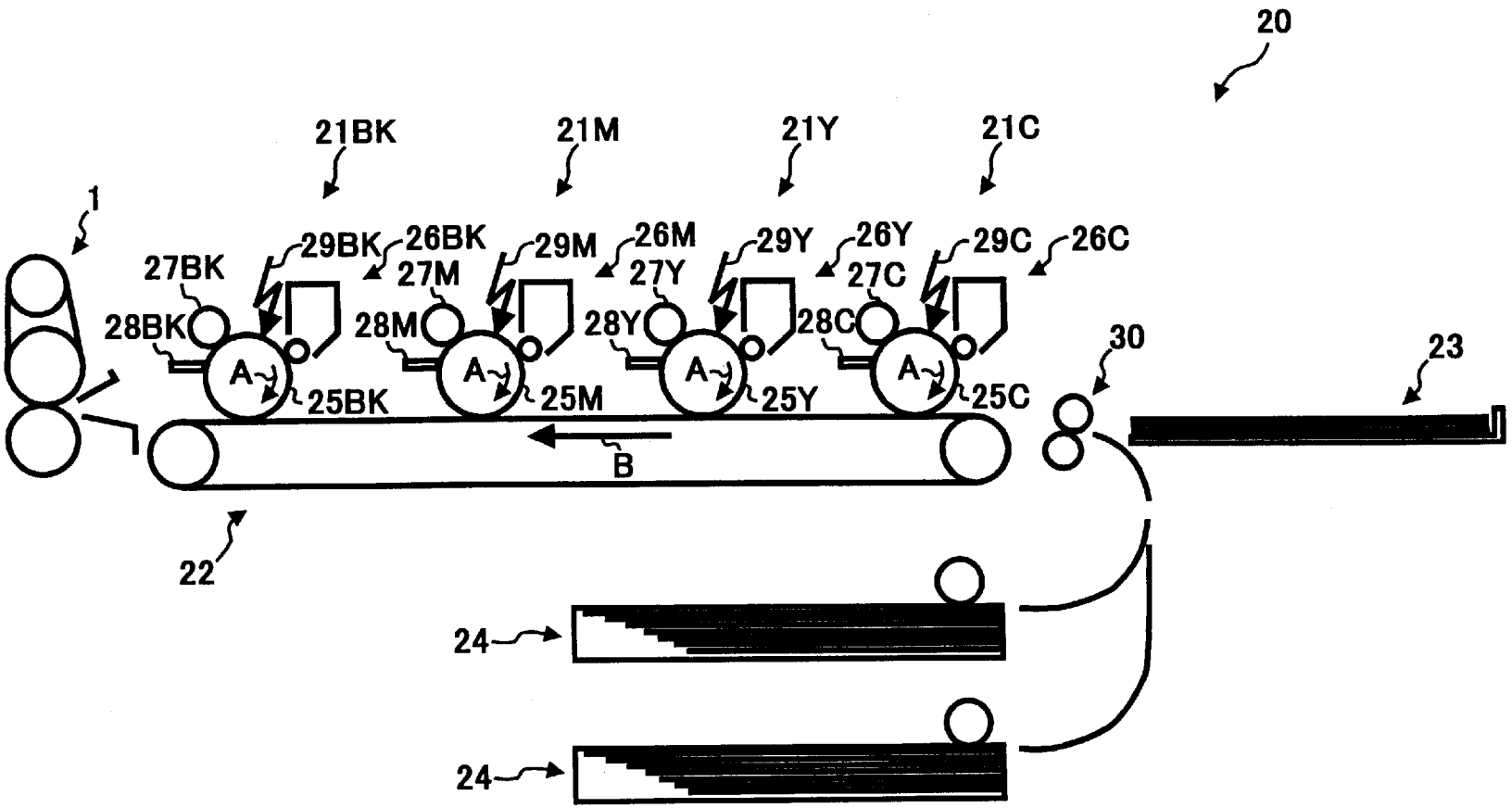
FIG. 1 is a side view schematically showing a fixing device, and a color image forming apparatus equipped with the fixing device, according to an embodiment of the present invention.

Referring now to the drawings, wherein like reference numerals designate identical or corresponding parts throughout the several views, preferred embodiments of the present invention are described.

FIG. 1 schematically shows an image forming apparatus 20 including the fixing device according to the present invention. The image forming apparatus 20 is a generally known one selected from a copying machine, a facsimile, a printer, and so on. In fact, any type of an image forming apparatus can be employed as long as it includes the fixing device of the invention. According to the invention, the image forming apparatus is designed to form color images. However, the image forming apparatus may be designed to form monochromatic images.

The image forming apparatus 20 includes image forming devices 21C, 21Y, 21M and 21BK for forming images of respective colors according to a document image, and a transfer device 22 disposed opposite to the image forming devices 21C, 21Y, 21M and 21BK. A manual tray 23 and paper feeding cassettes 24 and 24 are provided as a sheet-like medium feeding device for feeding various sheet-like media to a transfer region in which the image forming devices 21C, 21Y, 21M and 21BK and the transfer device 22 face each other. A resist roller 30 for feeding the sheet-like media conveyed from the manual tray 23 and the paper feeding cassettes 24 in matching with the image forming timings of the image forming devices 21C, 21Y, 21M and 21BK, and a fixing device 1 for fixing each of the transferred sheet-like media in the transfer region are also provided.

The image forming apparatus 20 can use, as a sheet-like medium, any one of plain paper generally used for copying or the like (simply referred to as plain paper, hereinafter), and a so-called special sheet having a heat capacity larger than that of a sheet of paper (simply referred to as a special sheet, hereinafter), such as an OHP sheet, 90K sheet, e.g., a card, a postcard or the like, a cardboard having a basic weight of about 100 g/m$^2$ or higher, an envelope or the like.

The image forming devices 21C, 21Y, 21M and 21BK are for development of respective colors of cyan, yellow, magenta and black. Though the colors of toner to be used are different, these devices are similar in constitution. Thus, the constitution of the image forming device 21C will be described as a representative of the image forming devices 21C, 21Y, 21M and 21BK. The image forming device 21C employs a generally known constitution, which includes a photosensitive drum 25C as an electrostatic latent image carrier and a charger 27C, a developing device 26C, a cleaner 28C, and so on, sequentially arranged in the rotational direction A of the photosensitive drum 25C. The photosensitive drum 25C receives an exposure light 29C between the charger 27C and the developing device 26C. The electrostatic latent image carrier may be belt-like instead of being drum-like.

Figure 2:
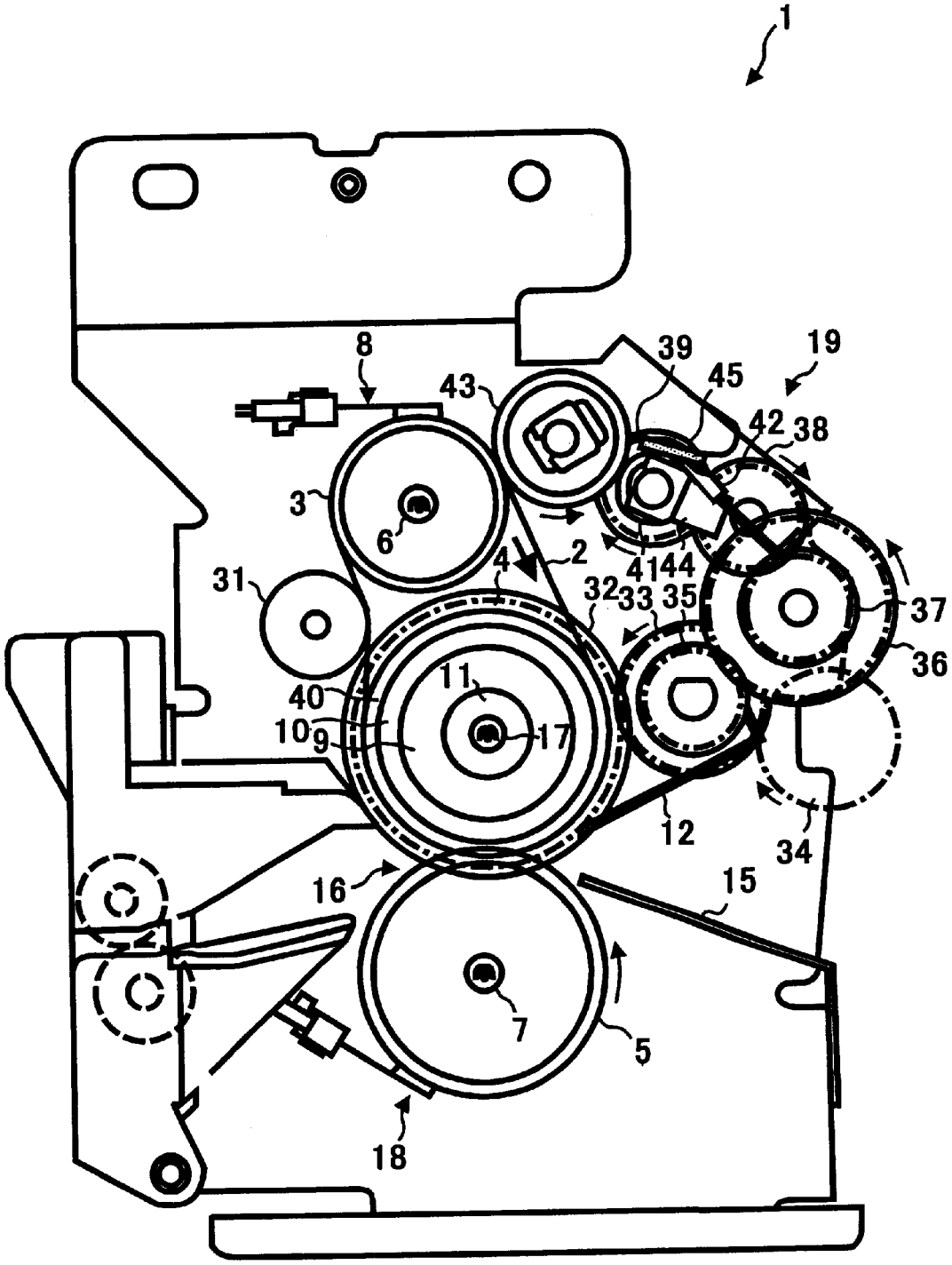
FIG. 2 is a side view of the fixing device shown in FIG. 1.

As shown in FIG. 2, the fixing device 1 includes an endless fixing belt 2 for conveying a sheet-like medium on which a toner image is to be fixed heating roller 3 and fixing roller 4 having the fixing belt 2 wound thereon, and a pressing roller 5 disposed opposite to the fixing roller 4 via the fixing belt 2. First to third heaters 6, 7 and 17 provided respectively inside the heating, pressure and fixing rollers 3, 5 and 4, and a thermistor 8 as a first temperature detecting device is disposed opposite to the heating roller 3 via the fixing belt 2 to detect the temperature of the fixing belt (temperature of the heating roller, to be exact). A thermistor 18 as a second temperature detecting device disposed opposite to the pressing roller 5 to detect the temperature of the pressing roller 5 and a releasing agent feeding device 19 is provided for feeding releasing agent mainly containing silicon oil to the fixing belt 2 or the like.

To apply predetermined proper tension to the fixing belt 2, in the outer peripheral surface of the fixing belt 2, a tension roller 31 is elastically abutted on the downstream side of the fixing roller 4 and upstream side of the heating roller 3 in the rotational direction of the fixing belt 2. The fixing roller 4 has a core 9 as a substrate, a heat resistant porous elastic layer 10 made of silicon rubber to cover the core 9, and a fluoro-rubber isolation layer 40 formed on the surface of the elastic layer 10 to isolate the elastic layer 10 from the releasing agent. The heater 17 is incorporated in a shaft 11 located at the center of the core 9. The insulting layer 40 covers not only the surface of the elastic layer 10 but also the side face of the fixing roller 4, and the inside of the fixing roller 4 is completely shielded from the releasing agent by the isolation layer 40. Instead of fluoro-rubber, a material for the isolation layer 40 may be one selected from phlorosilicon, Teflon, latex, and other suitable known materials.

The fixing roller 4 has a gear 32 integrally provided therein. This gear 32 is rotary-driven by a unit driving gear 33, thereby rotary-driving the fixing roller 4. The rotation of the heating roller 3 drives the fixing belt 2. The unit driving gear 33 is rotary-driven by a main body driving gear 34 disposed in the main body side of the image forming apparatus 20. The unit driving gear 33 has a gear 35 integrally provided as a driving device. The releasing agent feeding device 19 is driven by this gear 35.

The releasing agent feeding device 19 includes an idler 36 engaged with the gear 35, an idler 38 engaged with a gear 37 integrated with the idler 36, a feeding gear 39 engaged with the idler 38, and a feeding roller 41 integrated with the feeding gear 39. A felt 45 as a feeding member for feeding releasing agent to the feeding roller 41, and a releasing agent regulating blade 42 as a uniforming member elastically abutted on the feeding roller 41 to uniform the layer thickness of the releasing agent on the feeding roller 41 are also included. A coating roller 43 is disposed in a position opposite the heating roller 3 via the fixing roller 2 in such a way as to be abutted on the feeding roller 41 to receive the releasing agent fed therefrom, and on the fixing belt 2 to be rotated associatively therewith. Also provided a pressing device 44 with a built-in spring, not shown, for pressing the feeding roller 41 in a direction for its abutment on the coating roller 43, and pressing the coating roller 43 into contact with the fixing belt by predetermined pressure.

A linear velocity, i.e., a moving speed, of the fixing belt 2 is approximately 160 mm/s, which is larger than a circumferential speed of the feeding roller 41. However, because of friction between the coating roller 43 and the fixing belt 2, and friction between the coating roller 43 and the feeding roller 41, the coating roller 43 is rotated associatively with the fixing belt 2. In addition, since the coating roller 43 is disposed in the position opposite the heating roller 3 via the fixing belt 2, the fixing belt 2 is held between the coating roller 43 and the heating roller 3. Thus, the meandering of the fixing belt 2 in the vertical direction of a sheet surface shown in FIG. 2 can be prevented without affecting the tension of the fixing belt 2. The associative rotation of the coating roller 43 with the fixing belt 2 means that the coating roller 43 has no sliding resistance to the fixing belt 2. Accordingly, the prevention of the meandering of the fixing belt 2 is helped. To further enhance the meandering prevention of the fixing belt 2, a shaft-to-shaft distance between the heating and coating rollers 3 and 43 should preferably be set constant. Further, to prevent the meandering of the fixing belt 2, a belt meandering roller satisfying at least one of the above conditions may be provided opposite to the fixing roller 4.

The pressing roller 5 is suitably pressed in a direction for being pressed into contact with the fixing roller 4 by an elastic body such as a spring not shown. The pressing roller 5 is abutted on the fixing roller 4 via the fixing belt 2 in a position opposite to the fixing roller 4. Thus, a fixing portion 16 as a nip for abutting the pressing roller S on the fixing roller via the fixing belt 2 is formed. In the rotational upstream sides of the fixing belt 2 and the pressing roller 5 of the fixing portion 16, upper and lower guides 12 and 15 respectively are disposed so as to be open to the main body side of the image forming apparatus 20 and guide a sheet-like medium conveyed by the transfer device 22 on which a toner image is to be fixed toward the fixing portion 16.

Since the fixing portion 16 is formed only by the press-contact between the fixing roller 4 and the pressing roller 5 via the fixing belt 2, compared with a constitution where a part of the fixing portion is formed only by the abutment of the fixing belt 2 on the pressing roller 2 (e.g., Japanese Patent Application Laid-Open No. 10 (1998)-104979), the shifting or the occurrence of wrinkles in the sheet-like medium carrying toner can be prevented highly accurately, and good conveying performance of the sheet-like medium can be provided during fixing.

Though not shown, the fixing belt 2 has a silicon rubber releasing layer of 20 μm formed on a nickel substrate of a thickness 100 μm. A heat capacity of the fixing belt is small, and thermal responsiveness is high. The substrate may be made of polyimide and, if flexibility is considered, a thickness may be set in the range of 30 to 150 μm. The releasing layer should preferably have a thickness set in the range of 50 to 300 μm if silicon rubber is used, and in the range of 10 to 50 μm if a fluororesin group is used. Also, the releasing layer may be formed by laminating a fluororesin group on silicon rubber. The fixing belt 2 must not only have a characteristic of being instantaneously heated to a level not causing any hot offset, but also have a heat capacity necessary for sufficiently melting and fixing toner in the fixing region. The above-described material and thickness of the fixing belt 2 meet these requirements.

The fixing belt 2 receives tension of 3 kgf/ side applied by the tension roller 31. This tension can be set by adjusting the disposing position of the tension roller 31, and the range of 1 kgf (9.8 N) to 3 kgf (29.4 N) is preferable for performing good fixing. The heating and pressing rollers 3 and 5 are respectively made of thin cylindrical cores to set low heat capacities. The core of the heating roller 3 has a diameter of ≧20 mm to ≧30 mm, and a thickness of ≧0.3 mm to ≦2.0 mm. The core of the pressing roller 5 has a diameter of ≧30 mm to ≦50 mm, and a thickness of ≧0.3 mm to ≦1.5 mm. Thus, the heating roller 3 has a heat capacity set equal to 26 cal/° C. or lower, and the pressing roller 5 has a heat capacity set equal to 36 cal/° C. or lower.

In the embodiment, the core of the heating roller 3 is made of aluminum, having a diameter set at 30 mm, and a thickness set at 1.5 mm. The surface of the core is subjected to alumite treatment. For a material, one having small specific heat and large thermal conductivity is preferred. Other metals such as iron, copper and stainless can be used. If aluminum is used, and a roller diameter is 30 mm, a thickness can be set in the range of 0.6 mm to 1.5 mm; if iron is used and a roller diameter is 20 mm, a thickness can be set in the range of 0.7 mm to 1.4 mm; and if iron is used and a roller diameter is 30 mm, a thickness can be set in the range of 0.3 mm to 0.9 mm. A thickness is set to be smaller as a diameter is larger because of consideration given to the axial bending of the roller.

Such a lower limit value of a thickness is a permissible value when consideration is given to the deformation of the heating roller 3 caused by the above-described tension of the fixing belt 2. An upper limit value is a permissible value for obtaining desired rising time. The roller diameter is set equal to 20 mm or higher, in order to secure belt tension and prevent the axial bending of the roller. The roller diameter is set in the range of 20 mm to 30 mm, in order to obtain a heat capacity of 26 cal/° C. for causing the fixing belt 2 to maintain a constant temperature necessary for fixing even during continues sheet feeding, if a sheet-like conveying speed is 200 mm/s or lower.

By setting a low-heat capacity for the heating roller 3 as described above, heat is not taken away even by the rotation of the fixing belt 2, and fixing and rising time are respectively prevented from being adversely affected or being lengthened. Further, even when a temperature is lowered by continuous fixing or the like, time until its recovery is shortened. The heater 6 heats the heating roller 3 and the fixing belt 2 via the heating roller 3 to set a temperature at the fixing portion to be 130° C. The temperature of the heater 6 is controlled by the feeding-back of a detecting signal of the thermistor 8.

The elastic layer 10 of the fixing roller 4 is set equal to roller rubber hardness of 33° of ascar C (roller rubber hardness of 25° of JIS-A), which is relatively low. The hardness in this case can be set in the range of 10° to 50°. This range is preferred, because if the hardness is lower than 10°, nip pressure at the fixing portion 16 becomes short, causing the insufficient fixing of toner. Consequently, the lower limit temperature of fixing must be increased, and other inconveniences occur. If the hardness exceeds 50°, wrinkles occur in the sheet-like medium. To prevent the shortage of nip pressure and the generation of wrinkles in the sheet-like medium, as in the case of the embodiment, the hardness of 33° (25° of JIS-A) is preferable. As the material of the elastic layer is a heat resistant porous elastic body having small thermal conductivity and heat insulating property, the taking-away of belt heat is reduced, lowering a reduction in a temperature after rising, and shortening the time of pre-rotation for temperature recovery. In addition, since the elastic layer 10 is set at relatively low hardness, a sufficient nip width can be obtained even if the press-contacting force of the pressing roller 5 is small. The elastic layer 10 has a thickness set equal to 5 mm, and the isolation layer 40 has a thickness set equal to 30 μm.

Since the fixing roller 4 and the pressing roller 5 are always in the press-contacted state so as to form a nip portion, if the elastic layer 10 has high porosity, deformation may occur with the passage of time. For this reason, the elastic layer 10 may be made of solid silicon rubber having low porosity. In this case, though thermal conductivity is increased, heat transfer can be suppressed by the heating of the heater 17.

The pressing roller 5 has a core and a silicon rubber elastic layer formed on the surface of the core. The core is made of iron, having a diameter set at 30 mm, and a thickness at 1.0 mm. The elastic layer is made of silicon rubber, having a thickness set at 2 mm. For the material of the core, one having low specific heat and high thermal conductivity is preferable. However, other metals such as aluminum, copper and stainless can be used. If iron is used and a roller diameter is 30 mm, a thickness can be set in the range of 0.4 mm to 1.0 mm; if iron is used and a roller diameter is 50 mm, a thickness can be set in the range of 0.3 mm to 0.8 mm; if aluminum is used and a roller diameter is 30 mm, a thickness can be set in the range of 1.3 mm to 1.5 mm; and if aluminum is used and a roller diameter is 50 mm, a thickness can be set in the range of 0.6 mm to 1.2 mm. The thickness is set to be thinner as the diameter is lager because of consideration given to the axial bending of the roller. The elastic layer is not always necessary. However, if the elastic layer is present, it is preferred to provide an isolation layer similar to that of the fixing roller so as to at least cover the full surface of the elastic layer.

Such a lower limit value of the thickness of the core of the pressing roller 5 indicates a permissible value when consideration is given to the deformation of the pressing roller 5 caused by the surface pressure of 0.6 k g/cm$^2$ equivalent to the lower limit value of fixing pressure. An upper limit value indicates a permissible value for obtaining desired rising time. The roller diameter of 30 mm or higher is set, in order to set a range for securing fixing pressure and preventing the axial bending of the roller. The roller diameter is set in the range of 30 mm to 50 mm, in order to obtain a heat capacity of about 36 cal/° C. for causing the fixing belt 2 to maintain a constant temperature necessary for fixing even during continuous sheet feeding.

By setting a low heat capacity for the pressing roller 5 as described above, the heat thereof is not taken away even when the fixing belt 2 is rotated. Since the pressing roller 7 has the heater 7, fixing and rising times are respectively prevented from being adversely affected and being lengthened by the reduced temperature of the fixing belt 2. Further, even when a temperature is lowered by continuous fixing or the like, its recovery time is shortened. The heater 7 not only increases the temperature of the pressing roller 5 and shortens the rising time, but also provides stable fixing performance by supplying heat from the backside of the sheet-like medium during fixing. In addition, the pressing roller 5 can include a releasing layer of 10 $\mu$m to 30 $\mu$m on the elastic layer.

Figure 3:
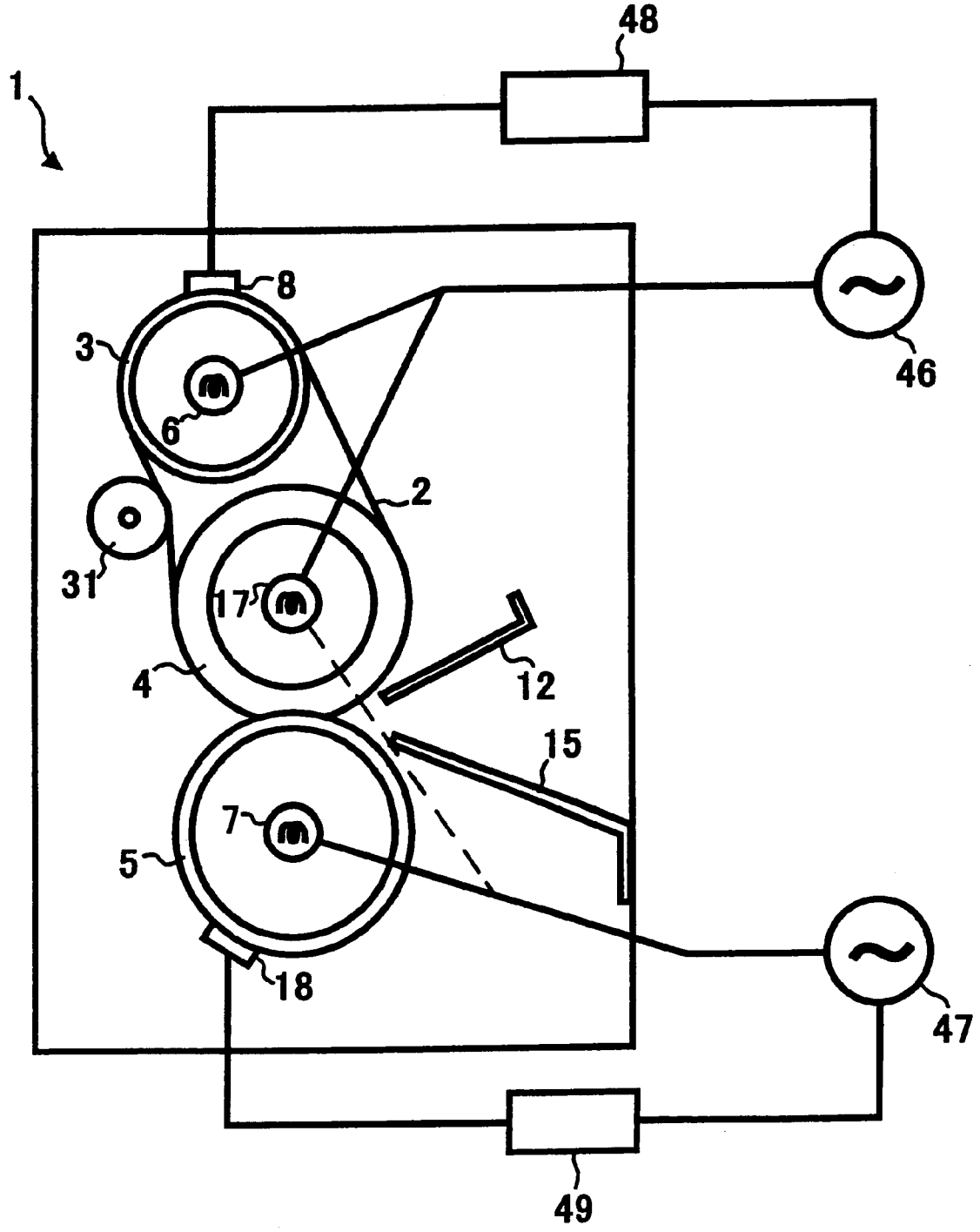
FIG. 3 is a schematic view showing a mode of connection among a heater, a voltage applying device and a temperature detecting device provided in the fixing device shown in FIG. 1 according to an embodiment of the present invention.

As shown in FIG. 3, the heaters 6 and 17 are connected to a power source 46 as identical voltage applying source, while the heater 7 is connected to a power source 47 as a voltage applying device. Heat is generated by applying voltages from these power sources 46 and 47. The heaters 6 and 17 are connected to the power source 46 in parallel. The voltages of the power sources 46 and 47 are both set at 100V. The outputs W1, W2 and W3 of the heaters 6, 7 and 17 are 500W, 400W and 150W, respectively, thus satisfying the relation of W1>W2>W3. The power source 46 and the thermistor 8 are interconnected through a control device 48, while the power source 47 and the thermistor 18 are interconnected through a control device 49.

A temperature detected by the thermistor 8 is compared with a set temperature 175° C. by the control device 48. If the detected temperature exceeds 175° C., then the application of voltages from the power source 46 to the heaters 6 and 17 is stopped. The thermistor 8 is provided corresponding to the heating roller 3 having thermal responsiveness higher than that of the fixing roller 4. Based on the temperature detected by the thermistor 8, the heaters 17 and 6 are simultaneously controlled by the power source 46. Accordingly, high thermal responsiveness (responsiveness in temperature control) is obtained and, under the condition of W1>W3, thermal deterioration at the elastic layer 10 of the fixing roller 4 can be prevented. Moreover, runaway heat can be surely prevented at any one of the heating and fixing rollers 3 and 4.

A temperature detected by the thermistor 18 is compared with a set temperature 150° C. by the control device 49. If the temperature exceeds 150° C., then the application of a voltage from the power source 47 to the heater 7 is stopped. Thus, the heaters 6 and 17 are simultaneously controlled by the identical power source 46 based on the temperature of the fixing belt 2 on the heating roller 3. By this control, the temperature of the fixing roller 4 heated by the heater 17 is maintained roughly at 100° C. in a stable state. The above-described relation of W1>W2>W3 satisfies the condition of controlling the temperature of the fixing roller 4 in such a manner.

The heater 17 can be connected to the power source 47 rather than to the power source 46 as schematically represented by the dashed line in FIG. 3. In this case, the heaters 7 and 17 are simultaneously controlled by the power source 47. In such a case, the thermistor 18 is provided corresponding to the pressing roller 5 having higher thermal responsiveness. When the heater 17 is connected to the power source 47, it is also preferred that the heaters 7 and 17 are connected to the power source 47 in parallel. In addition, the heater 17 may be connected to a power source provided separately from the power sources 46 and 47. From the viewpoint of a structure and easy control, however, the heater 17 should preferably be connected to the power source 46 or 47 as described above, and controlled simultaneously with the heater 6 or 7. The outputs of the heaters 6, 7 and 17 should preferably be set at 700 W or lower, considering an inrush current when a power switch is turned on, and the flickering phenomenon of a fluorescent lamp when the heater is turned on/off.

Figure 4:
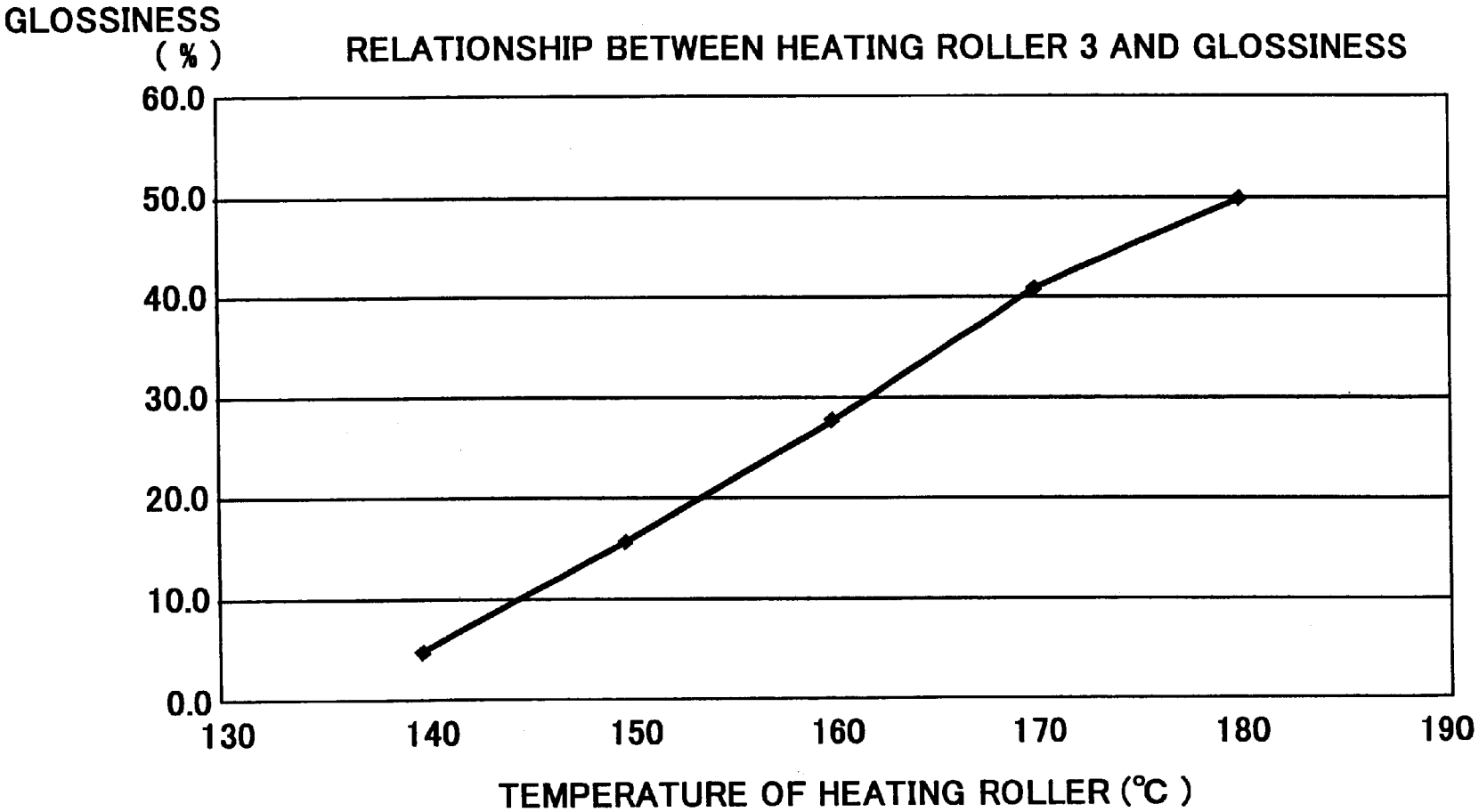
FIG. 4 is a correlation view showing a correlation between a temperature of a heating roller provided in the fixing device shown in FIG. 1, and glossiness of an image formed on a sheet-like medium.

In the fixing device 1, because of the heater 17 provided in the fixing roller 4, the glossiness of an image formed in each of the first several sheet-like media is improved regarding image formation during rising temperature after the power source turning-on of the image forming apparatus 2 or image formation carried out again with the passage of time after the previous image formation. As shown in FIG. 4, in the image forming apparatus 20, when the temperature of the heating roller 3 is lowered below 145° C., glossiness is also lowered below 10% as a standard, making it impossible to obtain a desired-quality image. As apparent from FIGS. 5 to 7, if the heater 17 is present, the temperature of the heating roller 3 is maintained at 145° C. or higher from the feeding of a first sheet, and glossiness is also maintained at 10% or higher. On the other hand, if the heater 17 is not present, the temperature of the heating roller 3 is lower than 145° C. at the time of feeding the first sheet, and glossiness is also lower than 10%. The number of fed sheets shown in FIGS. 5 and 6 is 5.

The reason why the reduction in the temperature of the heating roller 3 is low when the heater 17 is present can be explained as follows. That is, after the stoppage of pre-rotation at the time of temperature rising, or in a standby state after the previous image formation, the rotation of the fixing belt 2 is stopped and, then, with the starting of image formation, the rotation of the fixing belt 2 is started. At the time of starting this rotation, the fixing belt 2 has been heated not only by the heating roller 3 but also the fixing roller 4. Accordingly, even when the rotation of the fixing belt 2 is started, heat absorption by the fixing belt 2 is prevented from causing any great reductions in the temperature of the heating roller 3. Thus, when the heater 17 is present, even if a sheet-like medium is fed, the temperature of the heating roller 3 is maintained at 145° C. or higher, making it possible to perform good image formation. On the other hand, when the heater 17 is not present, since the fixing belt 2 has been heated only by the heating roller 3, with the starting of the rotation of the fixing belt 2, heat absorption by the fixing belt 2 causes a great reduction in the temperature of the heating roller 3. Consequently, at the time of feeding a first sheet, the temperature of the heating roller is further lowered by the heat absorption of the sheet-like medium, making it impossible to obtain desired image quality.

Figure 5:
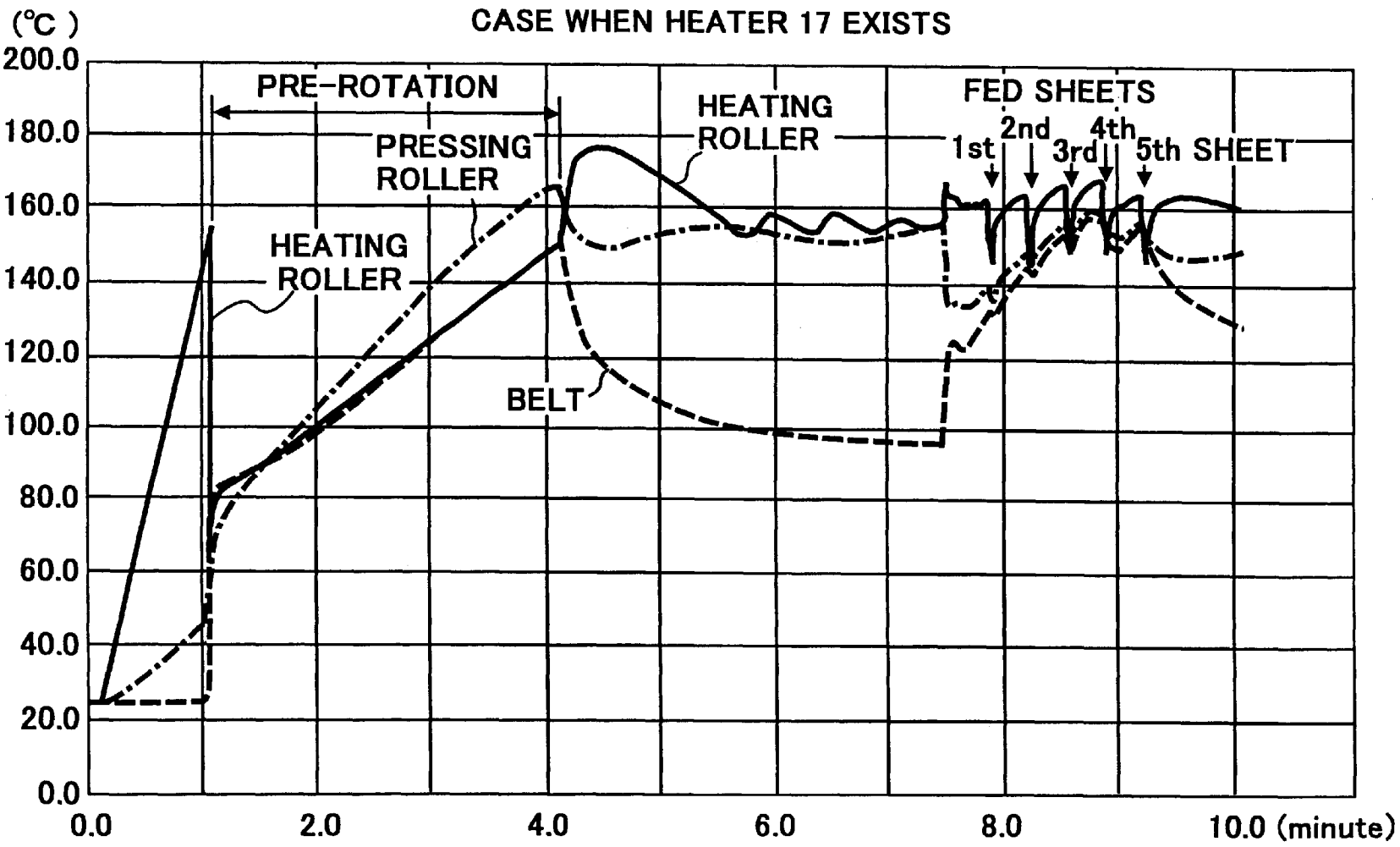
FIG. 5 is a correlation view showing a temperature change at each portion of the fixing device shown in FIG. 1 at the time of temperature rising, and specifically showing a relation between the number of fed sheet-like media and a temperature.
Figure 6:
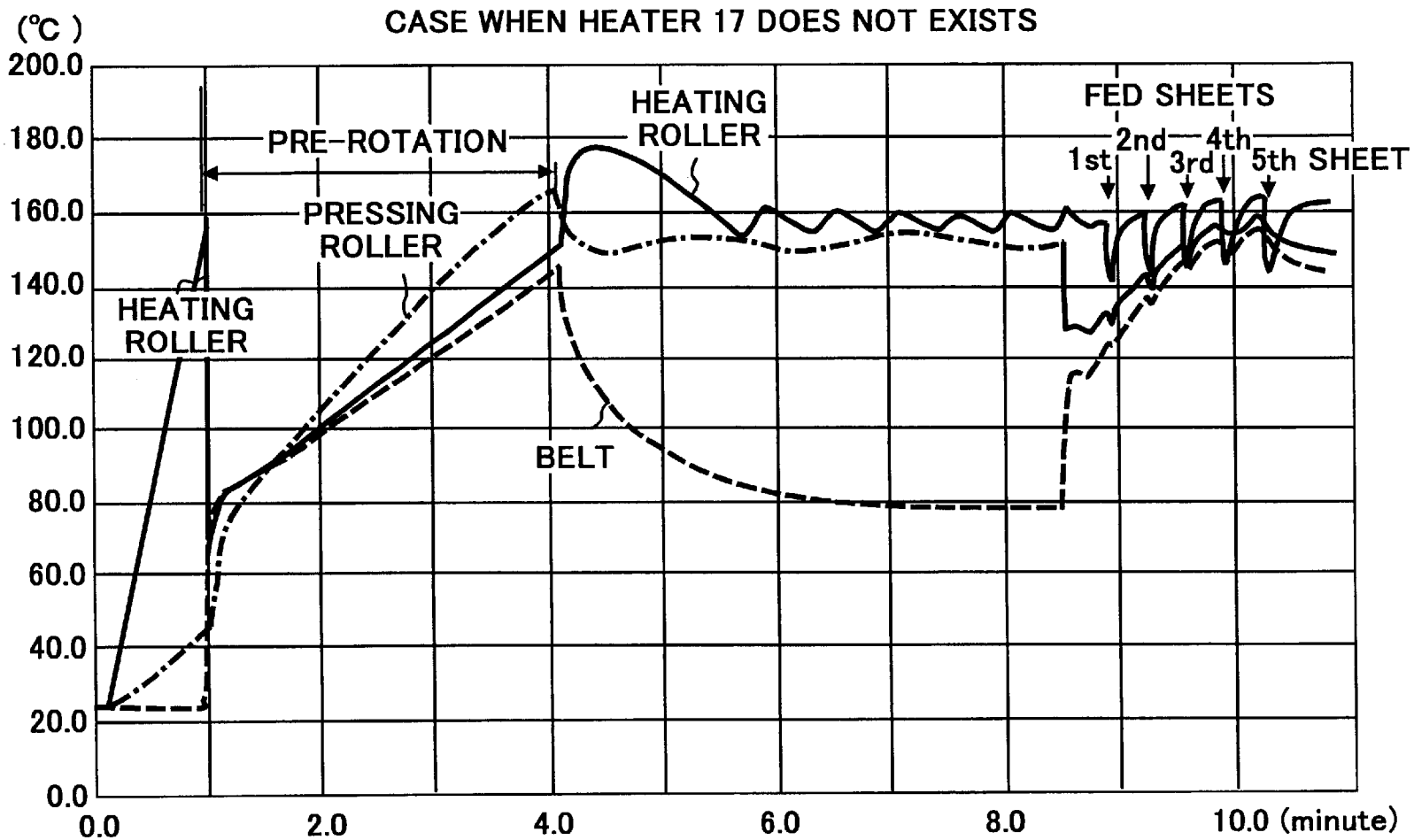
FIG. 6 is a correlation view showing a temperature change at each portion of a fixing device at the time of temperature rising the fixing device being different from the device shown in FIG. 1 in that a fixing roller has no heaters, and specifically showing a relation between the number of fed sheet-like media and a temperature.

FIGS. 5 to 7 shows the state at the time of rising temperature after the power source turning-on of the image forming apparatus 20. A similar result was discovered in the case after the passage of standby time from the previous image formation. In addition, as apparent from FIGS. 5 and 6, when the temperature of the heating roller 3 reaches 150° C., the fixing belt 2 is subjected to pre-rotation to increase the temperature of the entire fixing belt 2 to a certain extent. The temperature of the fixing belt 2 was detected by a thermistor provided in a position opposite the fixing roller 4 via the fixing belt 2, different from the embodiment of FIG. 2. With regard to fixing carried out by continuously feeding sheet-like media, in each case when 90 kg paper was used, and monochromatic image formation was carried out by 30 pieces/min or when color image formation was carried out by 6 pieces/min., fixing performance and glossiness were high. For color image formation, especially a glossy image is desired. By using the image forming apparatus 20 of the embodiment of FIG. 1, both at the time of starting image formation and during continuous sheet feeding, good color image formation can be carried out.

The fixing device 1 may be adapted to have a plain paper mode for performing fixing when a sheet-like medium is plain paper, a special sheet mode for performing fixing when a sheet-like medium is a special sheet, and monochrome and color modes for respectively performing monochromatic and color image forming operations for the above modes. According to one embodiment, the switching of these modes is carried out by selecting the special mode when the manual tray 23 is used, and selecting the monochrome or color mode by the operation of an operator. Other than these, in the period before the sheet-like medium reaches the fixing device 1, determination may be automatically made as to whether the sheet-like medium is plain paper or a special sheet by widely known means. Mode switching can also be made by direct selection made by the operator. Specifically, the operator directly selects a desired mode by depressing a key on a operation panel, not shown, provided in the main body side of the image forming apparatus 20. The operator can also select a desired mode indirectly through a control device. That is, the operator specifies a paper feeding cassette 24 to be used by an operation similar to the above, and then the control device automatically determines whether a sheet-like medium housed in the paper feeding cassette 24 is plain paper or a special sheet, and a mode is accordingly switched.

The conveying speed, i.e., the fixing speed, of a sheet-like medium by the fixing belt 2 can be changed according to each mode. In such a case, the fixing speed may be automatically changed when mode switching is carried out. Alternatively, the fixing speed may be selected and changed by the operation of the operator. If the fixing speed is lowered, the quantity of heat applied to the sheet-like medium in the fixing region is increased by a corresponding amount, facilitating the obtaining of a glossy image. This is because by supplying a sufficient quantity of fixing heat, a toner melting degree can be increased and the flatness of an image surface can be improved.

According to the embodiment constructed in the foregoing manner, after turning on the power source of the image forming apparatus 20, a state for enabling good fixing to be carried out is set, completing temperature rising. Thus, a state for enabling image formation and fixing to be carried out can be realized. When the operator performs a known operation to start image formation, following the rotation of the photosensitive drum 25C in a direction A, the photosensitive drum 25C is charged by the charger 27C, and an electrostatic latent image is formed by the exposure light 29C according to a document image. This electrostatic latent image is developed by the developing device 26C. A toner image formed on the photosensitive drum 25C is transferred onto a sheet-like medium conveyed in an arrow direction B on the known transfer device 22. After the transfer, residual toner on the photosensitive drum 25C is scraped away by the cleaner 28C to clean the photosensitive drum 25C. Then, the photosensitive drum 25C is charged for the next image transfer.

A sheet-like medium having cyan toner transferred thereon is conveyed in the arrow direction B on the transfer device 22. During the conveyance, yellow, magenta and black toner are properly transferred in sequence to the sheet-like medium by the image forming devices 21Y, 21M and 21BK performing the same image forming process as that of the image forming device 21C described above. After the completion of the transfer of all toner necessary for image formation, the sheet-like medium is passed from the transfer device 22 to the fixing device 1, and then guided to the fixing portion 16 by the upper and lower guides 12 and 15.

The sheet-like medium is conveyed by the movement of the fixing belt 2 and, at the fixing portion 16, toner is heated and pressurized to be melted and fixed on the sheet-like medium. Even in the case of continuous fixing, heat is supplied by the heating of the heaters 6, 7 and 17 to an extent causing no hot offset, and thus it is not necessary to perform reheating by suspending the fixing operation. After the fixing, the sheet-like medium is discharged out of the image forming apparatus. According to the fixing device 1, even in the case of carrying out OHP sheet fixing, a sufficiently large quantity of heat can be supplied in a range not causing any reduction in fixing quality such as hot offset or the like. Thus, the surface of the OHP sheet is made flat, suppressing irregular reflection and improving glossiness. In addition, since the absorption and scattering of a transmission light are suppressed inside toner, good image formation can be carried out.

Following the fixing, a releasing agent to be consumed is stuck to the sheet-like medium. Since the coating roller 43 is rotated following the rotation of the fixing belt 2, the releasing agent on the coating roller 43 is supplied to the fixing belt 2. The releasing agent is supplied to the coating roller 43 from the feeding roller 41. The releasing agent supplied from the felt 45 onto the feeding roller 41 has been uniformed to have a proper thickness by the releasing agent regulating blade 42. Thus, the proper and uniform amount of releasing agent is supplied to the coating roller 43. Accordingly, the releasing agent controlled to a proper and uniform amount is also supplied to the fixing belt 2. In the embodiment, for one A4 size sheet, releasing agent of 3 to 4 g is supplied to the fixing belt 2. Since the supplying of the releasing agent is carried out by the coating roller 43 formed in the roller shape to be rotated associatively with the fixing belt 2, the deterioration of the fixing belt 2 can also be suppressed.

Further, the releasing agent supplied to the fixing belt 2 is transferred from the end of the fixing belt 2 to the fixing roller 4. Since the fixing roller 4 has the isolation layer 40 formed therein, the fixing roller 4 is prevented from being swelled by the releasing agent, the traveling of the fixing belt 2 is stable even with time, and the sheet-like medium is conveyed always in a stable manner. Thus, the generation of wrinkles or a fixing failure in the sheet-like medium can be prevented.

The fixing device of the invention, and the image forming apparatus including this fixing device have been described. According to the embodiment, the temperatures controlled by the control devices 48 and 49 are respectively constant. However, such temperatures can be properly changed by a temperature inside or outside the image forming apparatus 20, detected by a thermometer, not shown, provided in the image forming apparatus 20. In addition, these temperatures should be adjusted by the thermal capacity or the like of each of the fixing belt 2, heating, fixing and pressing rollers 3, 4 and 5. For the thickness and the material of the fixing belt, and the diameter, the thickness and the material for each of the heating and pressing rollers, a proper combination can be made.

Furthermore, the feeding roller 41 is not always necessary, and the felt 45 may be abutted on the coating roller 43 to directly coat the releasing agent on the coating roller 43. In this case, the releasing agent regulating blade 42 is provided on the coating roller. With this constitution, though the stability of releasing agent supply is higher when the feeding roller 41 is provided, the constitution of the releasing agent feeding device 19 can be simplified more compared with the case of the feeding roller 41 present.

According to one aspect of the invention, the fixing device includes: the endless fixing belt for conveying a sheet-like medium, on which a toner image is to be fixed; the heating and fixing rollers having the fixing belt wound thereon; the pressing roller disposed opposite to the fixing roller via the fixing belt; the first to third heaters respectively provided in the heating, pressure and fixing rollers; the first to third voltage applying devices for respectively applying voltages to the first to third heaters; and the nip portion formed for performing fixing only by pressure contact between the fixing and pressing rollers via the fixing belt. Thus, since the temperature of the fixing roller is increased by the third heater, even when the rotation of the fixing belt is started, a steep temperature reduction caused by the abutment of the belt on the fixing roller is prevented. As a result, even at the time of starting fixing or even during continuous sheet feeding, a sufficient quantity of heat can be supplied to realize good fixing.

In addition, good conveying performance of a sheet-like medium can be secured during fixing, and a reduction in the quality of a printed matter can be prevented.

According to another aspect of the invention, in the fixing device thus constructed, the third voltage applying device is identical to the first or second voltage applying device. Thus, by the identical voltage applying device, voltages can be applied to the third voltage applying device and the first or second voltage applying device, and good fixing can be carried out with a simple constitution.

According to another aspect of the invention, the fixing device further includes: the first temperature detecting device disposed opposite to the heating roller via the fixing belt to detect a temperature of the heating roller; and the second temperature detecting means disposed opposite to the pressing roller to detect a temperature of the pressing roller. In this case, based on a temperature detected by the first or second temperature detecting device, the third heater and the first or second heater are controlled simultaneously by the identical voltage applying device. Thus, good fixing can be carried out by simple control.

According to another aspect of the invention, the fixing device includes: the endless fixing belt for conveying a sheet-like medium on which a toner image is to be fixed; the heating and fixing rollers having the fixing belt wound thereon; the pressing roller disposed opposite to the fixing roller via the fixing belt; the first to third heaters respectively provided in the heating, pressure and fixing rollers; and the first to third voltage applying devices for respectively applying voltages to the first to third heaters. In this case, the third voltage applying device is identical to the first or second voltage applying device. Thus, since the temperature of the fixing roller is increased by the third heater, even when the rotation of the fixing belt is started, a steep temperature reduction caused by the abutment of the belt on the fixing roller is prevented. As a result, even at the time of starting fixing, or even during continuous sheet feeding, a sufficient quantity of heat can be supplied to realize good fixing.

In addition, by the identical voltage applying device, voltages can be applied to the third voltage applying device and the first or second voltage applying device, and good fixing can be carried out with a simple constitution.

According to another aspect of the invention, the fixing device further includes: the first temperature detecting device disposed opposite to the heating roller via the fixing belt to detect a temperature of the heating roller; and the second temperature detecting device disposed opposite to the pressing roller to detect a temperature of the pressing roller. In this case, based on a temperature detected by the first or second temperature detecting device, the third heater and the first or second heater are controlled simultaneously by the identical voltage applying device. Thus, good fixing can be carried out by simple control.

According to another aspect of the invention, the fixing device includes: the endless fixing belt for conveying a sheet-like medium, on which a toner image is to be fixed; the heating and fixing rollers having the fixing belt wound thereon; the pressing roller disposed opposite to the fixing roller via the fixing belt; the first to third heaters respectively provided in the heating, pressure and fixing rollers; the first to third voltage applying devices for respectively applying voltages to the first to third heaters, the third voltage applying device being identical to the first or second voltage applying device; and the temperature detecting device provided in a roller having higher thermal responsiveness. In this case, based on a temperature detected by the temperature detecting device, the third heater and the first or second heater are controlled simultaneously by the identical voltage applying device. Thus, high thermal responsiveness can be always obtained, the thermal deterioration of the elastic layer of the fixing roller can be prevented, and runaway heat can be surely prevented.

According to another aspect of the invention, in the fixing device, the heaters having voltages applied thereto by the identical voltage applying device are connected to the voltage applying device in parallel. Thus, even by usual standard voltage applying device, heating by the third heater can be carried out without lowering the output of the first or second heater.

According to another aspect of the invention, in the fixing device, outputs W1, W2 and W3 respectively of the first to third heaters are set to satisfy the relation of W1>W2>W3. Thus, the heating of the fixing roller is set to a minimum necessary limit, the temperature of the fixing belt is maintained at a proper level, and the quantity of heat in the nip portion, necessary for fixing, is set to be proper. Therefore, good fixing can be carried out.

According to another aspect of the invention, the image forming apparatus includes: the fixing device for fixing a toner image on a sheet-like medium. In this case, the fixing device is one specified in any one of the above description. Thus, an image forming apparatus equipped with a fixing device having the foregoing advantages can be provided.

According to another aspect of the invention, the image forming apparatus is capable of forming color images. Thus, it is possible to provide an image forming apparatus having the foregoing advantages and obtaining high and stable glossiness even during color image formation required of high and stable glossiness.

Numerous additional modifications and variations of the present invention are possible in light of the above teachings. It is therefore to be understood that within the scope of the appended claims, the present invention may be practiced otherwise than as specifically described herein.

The present application claims priority and contains subject matter related to Japanese Patent Application Nos. 2000-151,627 & 2001-131,556 filed in the Japanese Patent Office on May 23, 2000 & Apr. 27, 2001, the entire contents of which are hereby incorporated by reference.

What is claimed:

1. A fixing device comprising:

an endless fixing belt configured to convey a sheet-like medium on which a toner image is to be fixed;

heating and fixing rollers having said fixing belt wound thereon;

a pressing roller disposed opposite to said fixing roller having said fixing belt wound thereon to form a nip portion between the fixing belt and pressing roller;

first, second, and third heaters provided respectively in said heating, pressing and fixing rollers;

first, second, and third voltage applying devices configured to apply voltages to said first, second, and third heaters respectively, wherein said nip portion is configured to perform fixing by pressure contact between said fixing and pressing rollers via said fixing belt, and wherein said heating roller is maintained at 145° C. or higher such that a glossiness of the toner image is at least 10%.

2. The fixing device according to claim 1, wherein said third voltage applying device is integrated with said first or second voltage applying device to form an identical voltage supplying device.

3. The fixing device according to claim 2, further comprising:

first temperature detecting device disposed opposite to said heating roller via said fixing belt and configured to detect a temperature of said heating roller; and second temperature detecting device disposed opposite to said pressing roller and configured to detect a temperature of said pressing roller, wherein on the basis of a temperature detected by said first or second temperature detecting device, said third heater and said first or second heater are simultaneously controlled by said identical voltage applying device.

4. A fixing device comprising:

an endless fixing belt configured to convey a sheet-like medium on which a toner image is to be fixed;

heating and fixing rollers having said fixing belt wound thereon;

a pressing roller disposed opposite to said fixing roller having said fixing belt wound thereon;

first, second, and third heaters provided in said heating, pressing and fixing rollers; and first, second, and third voltage applying devices configured to apply voltages to said first, second, and third heaters respectively, wherein said third voltage applying device is integrated with said first or second voltage applying device to form an identical voltage supplying device, and wherein said heating roller is maintained at 145° C. or higher such that a glossiness of the toner image is at least 10%.

5. The fixing device according to claim 4, further comprising:

first temperature detecting device disposed opposite to said heating roller via said fixing belt and configured to detect a temperature of said heating roller; and second temperature detecting device disposed opposite to said pressing roller and configured to detect a temperature of said pressing roller, wherein on the basis of a temperature detected by said first or second temperature detecting device, said third heater and said first or second heater are simultaneously controlled by said identical voltage applying device.

6. A fixing device comprising:

an endless fixing belt configured to convey a sheet-like medium, on which a toner image is to be fixed;

heating and fixing rollers having said fixing belt wound thereon;

a pressing roller disposed opposite to said fixing roller having said fixing belt wound thereon;

first, second, and third heaters provided in said heating, pressing and fixing rollers respectively; and first, second, and third voltage applying devices configured to apply voltages to said first, second, and third heaters respectively, wherein said third voltage applying device is integrated with said first or second voltage applying device to form an identical voltage supplying device, a temperature detecting device is provided in one of said heating and pressing rollers having a higher thermal responsiveness, and on the basis of a temperature detected by said temperature detecting device, said third heater and said first or second heater are simultaneously controlled by said identical voltage applying device.

7. The fixing device according to claim 2, wherein said heaters having voltages applied thereto by said identical voltage applying device are connected to the identical voltage applying device in parallel.

8. The fixing device according to claim 4, wherein said heaters having voltages applied thereto by said identical voltage applying device are connected to the identical voltage applying device in parallel.

9. The fixing device according to claim 6, wherein said heaters having voltages applied thereto by said identical voltage applying device are connected to the identical voltage applying device in parallel.

10. The fixing device according to claim 1, wherein outputs W1, W2 and W3 of said first, second, and third heaters are set to satisfy a relation of W1>W2>W3.

11. The fixing device according to claim 4, wherein outputs W1, W2 and W3 of said first, second, and third heaters are set to satisfy a relation of W1>W2>W3.

12. The fixing device according to claim 6, wherein outputs W1, W2 and W3 of said first, second, and third heaters are set to satisfy a relation of W1>W2>W3.

13. An image forming apparatus comprising:

an image forming device configured to form a toner image on a photosensitive member and to transfer the toner image on a sheet-like medium; and a fixing device comprising an endless fixing belt configured to convey a sheet-like medium on which a toner image is to be fixed;

heating and fixing rollers having said fixing belt wound thereon;

a pressing roller disposed opposite to said fixing roller having said fixing belt wound thereon to form a nip portion between the fixing belt and pressing roller;

first, second, and third heaters provided respectively in said heating, pressing and fixing rollers; and first, second, and third voltage applying devices configured to apply voltages to said first, second, and third heaters respectively, wherein said nip portion is configured to perform fixing by pressure contact between said fixing and pressing rollers via said fixing belt, and wherein said heating roller is maintained at 145° C. or higher such that a glossiness of the toner image is at least 10%.

14. The image forming apparatus of claim 13, wherein said third voltage applying device is integrated with said first or second voltage applying device to form an identical voltage supplying device.

15. The image forming apparatus of claim 14, wherein said fixing device further comprises first temperature detecting device disposed opposite to said heating roller via said fixing belt and configured to detect a temperature of said heating roller; and second temperature detecting device disposed opposite to said pressing roller and configured to detect a temperature of said pressing roller, wherein on the basis of a temperature detected by said first or second temperature detecting device, said third heater and said first or second heater are simultaneously controlled by said identical voltage applying device.

16. The image forming apparatus according to claim 13, wherein the image forming apparatus is capable of forming color images.

17. A fixing device comprising:

an endless fixing belt configured to convey a sheet-like medium on which a toner image is to be fixed;

rolling means for heating and rolling means for fixing, each having said fixing belt wound thereon;

rolling means for pressing disposed opposite to said rolling means for fixing having said fixing belt wound thereon to form a nip portion between the fixing belt and rolling means for fixing;

first, second, and third means for heating provided in said rolling means for heating, rolling means for pressing and rolling means for fixing respectively; and first, second, and third means for applying voltages to said first, second, and third heating means wherein said nip portion is configured to perform the fixing by pressure contact between said fixing and pressing rolling means via said fixing belt, and wherein said rolling means for heating is maintained at 145° C. or higher such that a glossiness of the toner image is at least 10%.

18. A fixing device comprising:

an endless fixing belt configured to convey a sheet-like medium on which a toner image is to be fixed;

rolling means for heating and rolling means for fixing each having said fixing belt wound thereon;

rolling means for pressing disposed opposite to said rolling means for fixing having said fixing belt wound thereon to form a nip portion between the fixing belt and rolling means for fixing;

first, second, and third means for heating provided in said rolling means for heating, rolling means for pressing and rolling means for fixing respectively; and first, second, and third means for applying voltages to said first, second, and third means for heating respectively, wherein said third means for applying voltage is identical to said first or second means for applying voltage, and wherein said rolling means for heating is maintained at 145° C. or higher such that a glossiness of the toner image is at least 10%.

19. A fixing device comprising:

an endless fixing belt configured to convey a sheet-like medium on which a toner image is to be fixed;

rolling means for heating and rolling means for fixing, each having said fixing belt wound thereon;

rolling means for pressing disposed opposite to said rolling means for fixing having said fixing belt wound thereon;

first, second, and third means for heating provided in said rolling means for heating, rolling means for pressing and rolling means for fixing respectively; and first, second, and third means for applying voltages to said first, second, and third means for heating, wherein said third means for applying voltage is identical to said first or second means for applying voltage to form an identical voltage applying means;

a temperature detecting means is provided in one of said rolling means having a higher thermal responsiveness, and on the basis of a temperature detected by said temperature detecting means, said third means for heating and said first or second means for heating are simultaneously controlled by said identical voltage applying means.

20. A fixing method comprising:

conveying a sheet-like medium on which a toner image is to be fixed by an endless fixing belt;

applying voltages to first, second, and third heaters from first, second, and third voltage applying devices respectively;

providing said first, second, and third heaters in heating, pressing and fixing rollers respectively to thereby heat such rollers; and performing fixing of an image by pressure contact between said fixing roller having said fixing belt wound thereon, and said pressing roller which form a nip portion, and maintaining said heating roller at 145° C. or higher such that a glossiness of the toner image is at least 10%.

21. A fixing method comprising:

conveying a sheet-like medium on which a toner image is to be fixed by an endless fixing belt;

applying voltages to first, second, and third heaters from first, second, and third voltage applying devices respectively; and providing said first, second, and third heaters in heating, pressing and fixing rollers respectively to thereby heat such rollers, wherein said third voltage applying device is identical to said first or second voltage applying device, and maintaining said heating roller at 145° C. or higher such that a glossiness of the toner image is at least 10%.

22. A fixing method comprising:

conveying a sheet-like medium on which a toner image is to be fixed by an endless fixing belt;

applying voltages to first, second, and third heaters from first, second, and third voltage applying devices respectively;

providing said first, second, and third heaters in heating, pressing and fixing rollers respectively to thereby heat such rollers;

wherein said third voltage applying device is identical to said first or second voltage applying device to form an identical voltage applying device;

providing a temperature detecting device in one of said rollers which has a higher thermal responsiveness; and on the basis of a temperature detected by said temperature detecting device, simultaneously controlling said third heater and said first or second heater by said identical voltage applying device.

* * * * *